US010385634B2

(12) United States Patent
Pover

(10) Patent No.: US 10,385,634 B2
(45) Date of Patent: Aug. 20, 2019

(54) DRILL ROD HANDLER

(71) Applicant: Ormarc Engineering Pty Ltd, Davenport (AU)

(72) Inventor: Scott Pover, Davenport (AU)

(73) Assignee: Ormarc Engineering Pty Ltd, Davenport, Western (AU)

( * ) Notice: Subject to any disclaimer, the term of this patent is extended or adjusted under 35 U.S.C. 154(b) by 0 days.

(21) Appl. No.: 15/304,222

(22) PCT Filed: Apr. 10, 2015

(86) PCT No.: PCT/AU2015/050162
§ 371 (c)(1),
(2) Date: Oct. 14, 2016

(87) PCT Pub. No.: WO2015/157815
PCT Pub. Date: Oct. 22, 2015

(65) Prior Publication Data
US 2017/0044852 A1 Feb. 16, 2017

(30) Foreign Application Priority Data
Apr. 14, 2014 (AU) ..... 2014901358

(51) Int. Cl.

| | |
|---|---|
| ***E21B 19/00*** | (2006.01) |
| ***B66C 1/42*** | (2006.01) |
| ***E21B 19/16*** | (2006.01) |
| ***E21B 19/15*** | (2006.01) |
| ***E21B 19/14*** | (2006.01) |

(52) U.S. Cl.
CPC ..... *E21B 19/155* (2013.01); *E21B 19/14* (2013.01)

(58) Field of Classification Search
CPC ..... E21B 19/155; E21B 19/14; E21B 19/20; E21B 19/15; E21B 7/02
See application file for complete search history.

(56) References Cited

U.S. PATENT DOCUMENTS 3,112,830 A * 12/1963 Podlesak ..... B66C 13/18 294/106
3,322,456 A * 5/1967 Strakhal ..... E21B 19/00 24/493

(Continued)

FOREIGN PATENT DOCUMENTS

AU 2005202267 12/2005 ..... E21B 19/00
WO WO 2000/65193 11/2000 ..... E21B 19/20

(Continued)

OTHER PUBLICATIONS

International Search Report from corresponding International Patent Application No. PCT/AU2015/050162, dated Jul. 22, 2015.

*Primary Examiner* — Gregory W Adams
(74) *Attorney, Agent, or Firm* — Kusner & Jaffe

(57) ABSTRACT

A drill rod handler provides rods to be used to form a drill string in on-shore drilling operations. The drill rod handler includes side arms which are moveable to encourage drill rods to roll towards or away from a center line of the drill rod handler. A working arm is arranged to grasp a centrally located drill rod, and to raise it from a horizontal to a vertical configuration. The working arm may then slew to correctly position the drill rod at the correct location for use.

6 Claims, 15 Drawing Sheets

(56) References Cited

U.S. PATENT DOCUMENTS 3,491,811 A * 1/1970 Larson ..... B27M 1/00 144/34.1
3,561,615 A * 2/1971 Forsberg ..... F16L 1/09 29/237
3,734,209 A * 5/1973 Haisch ..... E21B 7/20 166/379
4,403,897 A * 9/1983 Willis ..... E21B 19/155 269/238
4,718,805 A 1/1988 Becker ..... 414/22
5,423,390 A * 6/1995 Donnally ..... E21B 19/14 166/77.52
5,941,324 A 8/1999 Bennett ..... 175/85
6,298,927 B1 * 10/2001 Back ..... E21B 19/14 166/77.51
6,637,482 B2 * 10/2003 Koponen ..... A01G 23/081 144/24.13
7,036,202 B2 * 5/2006 Lorenz ..... E21B 19/155 166/77.51
7,469,749 B2 * 12/2008 Folk ..... E21B 7/02 166/379
7,503,606 B2 * 3/2009 Hall ..... B66C 1/28 294/81.52
7,946,795 B2 * 5/2011 Orgeron ..... E21B 19/155 166/77.52
8,083,009 B2 * 12/2011 Comacchio ..... E21B 19/14 175/52
8,186,926 B2 * 5/2012 Littlely ..... E21B 19/155 33/366.24
8,221,049 B1 * 7/2012 Westendorf ..... E02F 3/404 294/106
8,240,968 B2 * 8/2012 Hopkins ..... E21B 19/155 414/22.55
8,328,071 B2 * 12/2012 LaValley ..... B26D 3/16 228/212
8,328,258 B2 * 12/2012 Kjol ..... B66C 1/58 294/106
8,348,319 B2 * 1/2013 LaValley ..... E21B 19/14 294/81.61
2004/0217612 A1 * 11/2004 Slettedal ..... E21B 19/14 294/202
2005/0269133 A1 * 12/2005 Little ..... E21B 19/14 175/52
2008/0296063 A1 * 12/2008 Marshman ..... B60F 3/0015 175/20
2009/0060685 A1 * 3/2009 Godfrey ..... A01G 23/006 414/23
2011/0148133 A1 * 6/2011 Hessels ..... E21B 19/163 294/197
2013/0343838 A1 * 12/2013 Flusche ..... B65G 47/82 414/22.62

FOREIGN PATENT DOCUMENTS

WO WO 2001/51762 7/2001 ..... E21B 19/15
WO WO 2012/148286 11/2012 ..... E21B 19/15

* cited by examiner

DRILL ROD HANDLER

FIELD OF THE INVENTION

The present invention relates to the transport and use of pipes and rods used in on-shore drilling applications, such as in the sinking of bores into aquifers.

BACKGROUND TO THE INVENTION

Drilling operations such as the sinking of bores into aquifers require the use of vertically aligned pipes or rods. In general, it is not practical above the ground to erect a drill string which is sufficiently long to achieve the required depth once inserted into the ground. Instead, a drill string is provided in rods or pipes above a drill stem, each of which is joined in turn to the drill string as the drill stem is lowered into the ground.

Transportation of rod sections and on-site handling of rods represent difficult operations. Generally a truck is required to transport the rods (horizontally), and then a crane is required to lift each rod and to manoeuver it into position. These operations are both time consuming and labour intensive.

The present invention seeks to provide a means of transporting and/or erecting drill string rods which addresses these concerns.

SUMMARY OF THE INVENTION

According to one aspect of the present invention there is provided a handler for elongate members, the handler including a bed on which the elongate members can be located in a generally horizontal configuration, and a working arm, the working arm having a grasping means, the working arm being moveable relative to the bed such that the grasping means is moveable between a horizontal configuration and a vertical configuration.

The elongate members may be drill rods as used in a drill string.

Preferably the working arm is moveable through at least two degrees of freedom. This may be rotation about a horizontally aligned axis, and rotation about a vertical axis.

The bed may include at least one inclined surface, inclined in a transverse direction relative to a longitudinal direction of the elongate members when located horizontally. It is preferred that the bed includes two inclined surfaces, arranged in a 'V-shape'. In this way, the bed includes a primed position lower than the surrounding areas, into which a single drill rod is encouraged to roll by the action of gravity.

The bed may be associated with a selector, associated with the primed position. The selector may be arranged to elevate a drill rod from the primed position into an elevated position. The selector preferably includes a cradle arranged to support a drill rod, and legs arranged to raise the cradle relative to the bed.

The grasping means may be associated with a grabbing arm. The grabbing arm may be fixed to the working arm. Preferably, the grabbing arm is detachably connected to the working arm at a pivot, and includes an angle adjustment means enabling the relative angle of the working arm and the grabbing arm to be altered. The handler may be arranged for use with a number of interchangeable grabbing arms, for instanced sized for use with different sized drill rods.

In accordance with a second aspect of the present invention there is provided a grabbing arm for use in the movement and manipulation of elongate members, such as drill rods, the grabbing arm being generally elongate and including at least two grasping means arranged to selectively locate about an elongate member.

Preferably each grasping means includes two grasping members, a first grasping member having a first effective circumference and the second grasping member having a second effective circumference. The first effective circumference is similar to the circumference of the elongate member to be moved. The second effective circumference is larger than the first effective circumference. In this way each grasping means has a grasping member which is able to hold the drill rod, and a grasping member which is able to locate around the drill rod, and act as a back-up holding mechanism.

Each grasping means may include a set of jaws operated by a linking structure. The linking structure may be arranged such that the operation of an operating cylinder causes opening and closing of the jaws. It is preferred that the operating cylinder is arranged to operate radially relative to the area bounded by the jaws.

The grabbing arm may have a moveable foot. The moveable foot may be arranged to move in an elongate direction, for instance to engage the base of a drill rod.

The grabbing arm preferably includes a detection means to indicate whether an elongate member is in position to be grasped by the grasping means. This may be a proximity detector.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
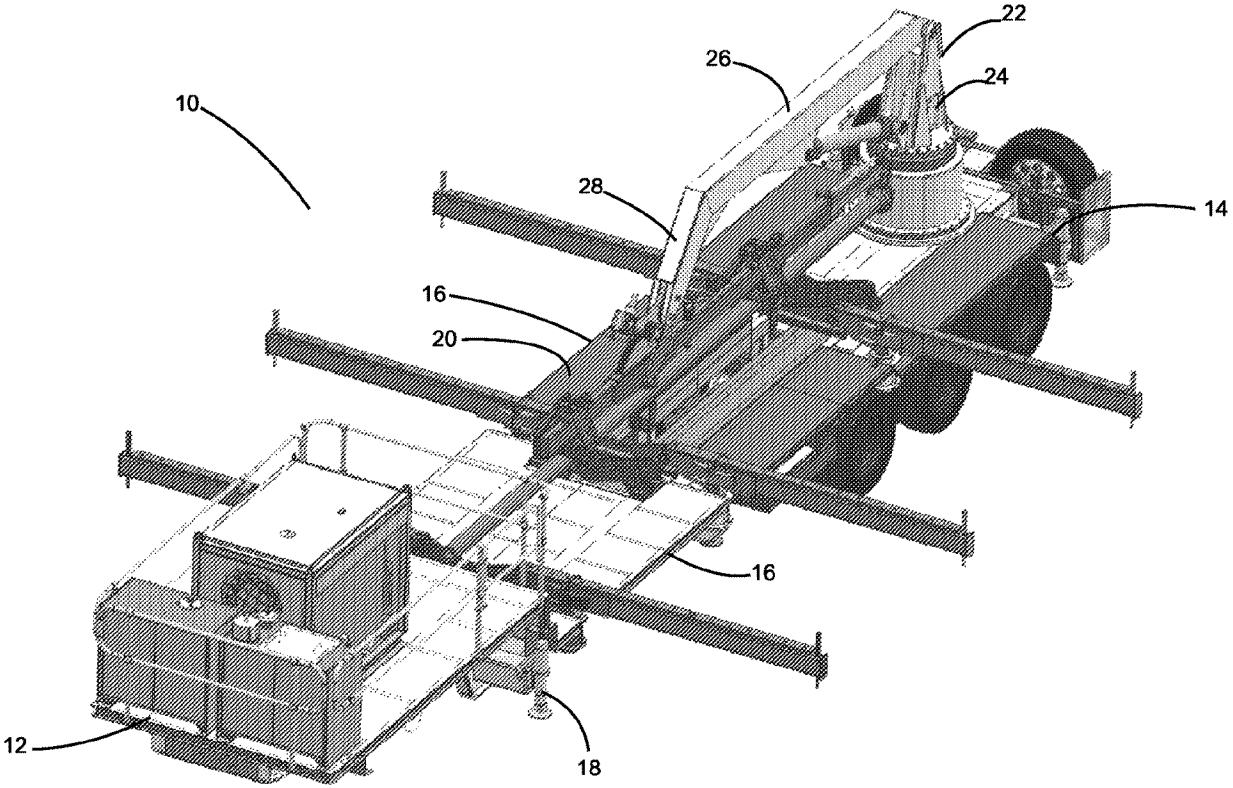
FIG. 1 is a schematic perspective of a drill rod handler in accordance with the present invention.
Figure 2:
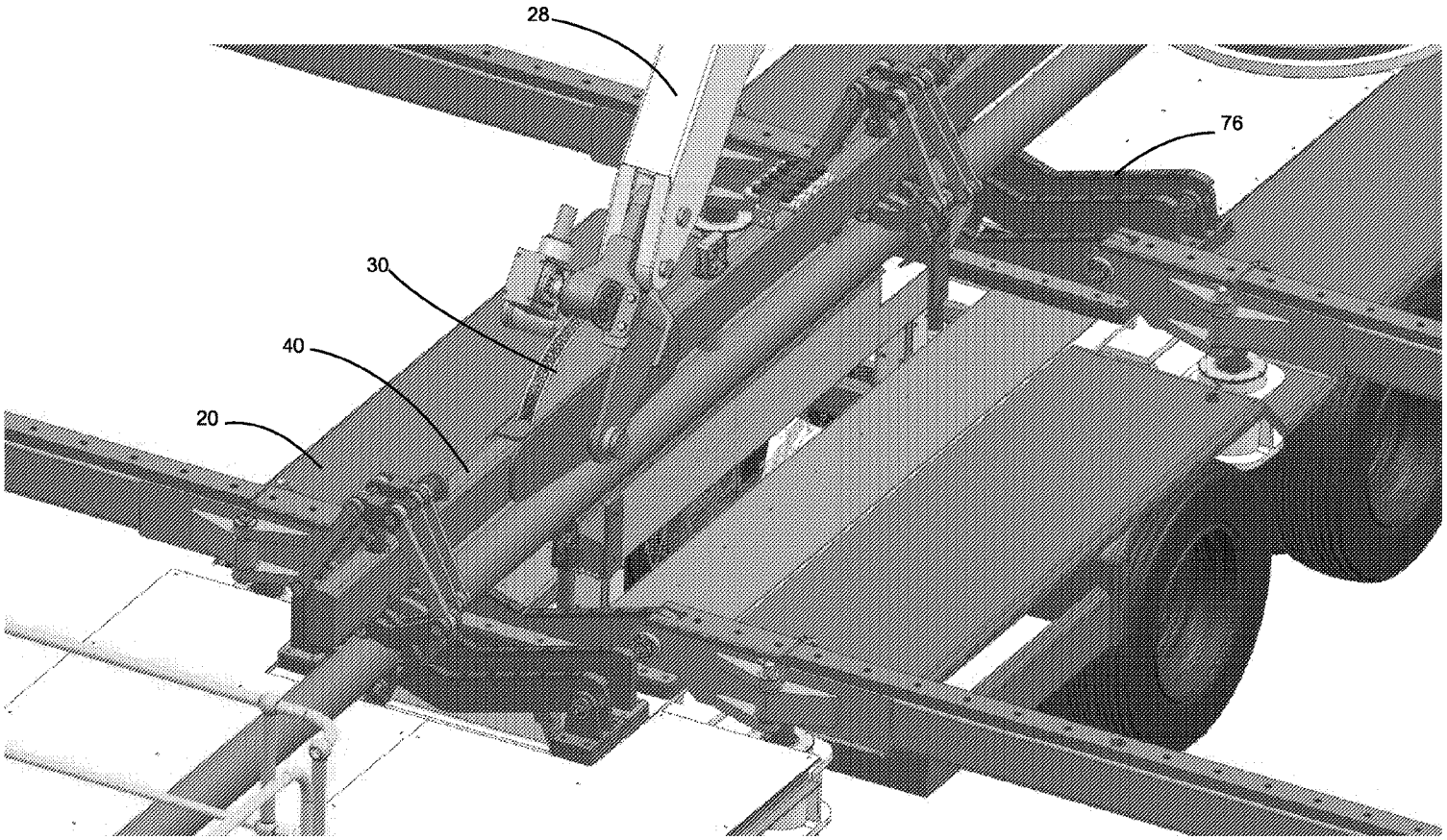
FIG. 2 is an enlarged view of a portion of the drill rod handler of FIG. 1.

Referring to the Figures, FIG. 1 shows a handler 10 for the transportation of drilling rods, being elongate members. The handler 10 is in the form of a trailer arranged for attachment to a prime mover or tractor unit in known fashion. The handler 10 as shown in the drawings is part of a six-wheeled trailer.

The handler 10 has a forward end 12, a rear end 14 and two side edges 16. The handler 10 includes two stabilizers or outriggers 18 along each side edge 16, which can be deployed for use or retracted for transportation in known fashion.

The handler 10 has a generally rectangular bed 20, having an elongate direction extending from near the forward end 12 to the rear end 14, and a transverse direction extending from one side edge 16 to the other side edge 16.

A hydraulic lifting device or boom arm assembly 22 is mounted towards the rear end 14 of the bed 20. The boom arm assembly 22 has a base post 24, arranged to slew about a vertical axis, and a working arm 26, pivotally connected to the base post 24 and arranged to rotate relative to the base post 24 about a horizontal axis.

The working arm 26 is generally elongate, with an angled distal end portion 28. The arrangement is such that when the boom arm assembly 22 is in the rest position, as shown in FIG. 1, the working arm 26 extends in the elongated direction, parallel to and spaced from the bed 20. The distal end portion 28 is angled towards the bed 20 at an angle of about 120°.

A rotational coupling 30 is mounted to an outer end of the distal end portion 28. A grabbing arm 40 is mounted to the rotational coupling 30. The rotational coupling 30 is arranged such that the particular grabbing arm 40 can be readily exchanged for an alternative grabbing arm 40, for instance for use in the deployment of drill rods of different sizes.

Figures 4, 4A:
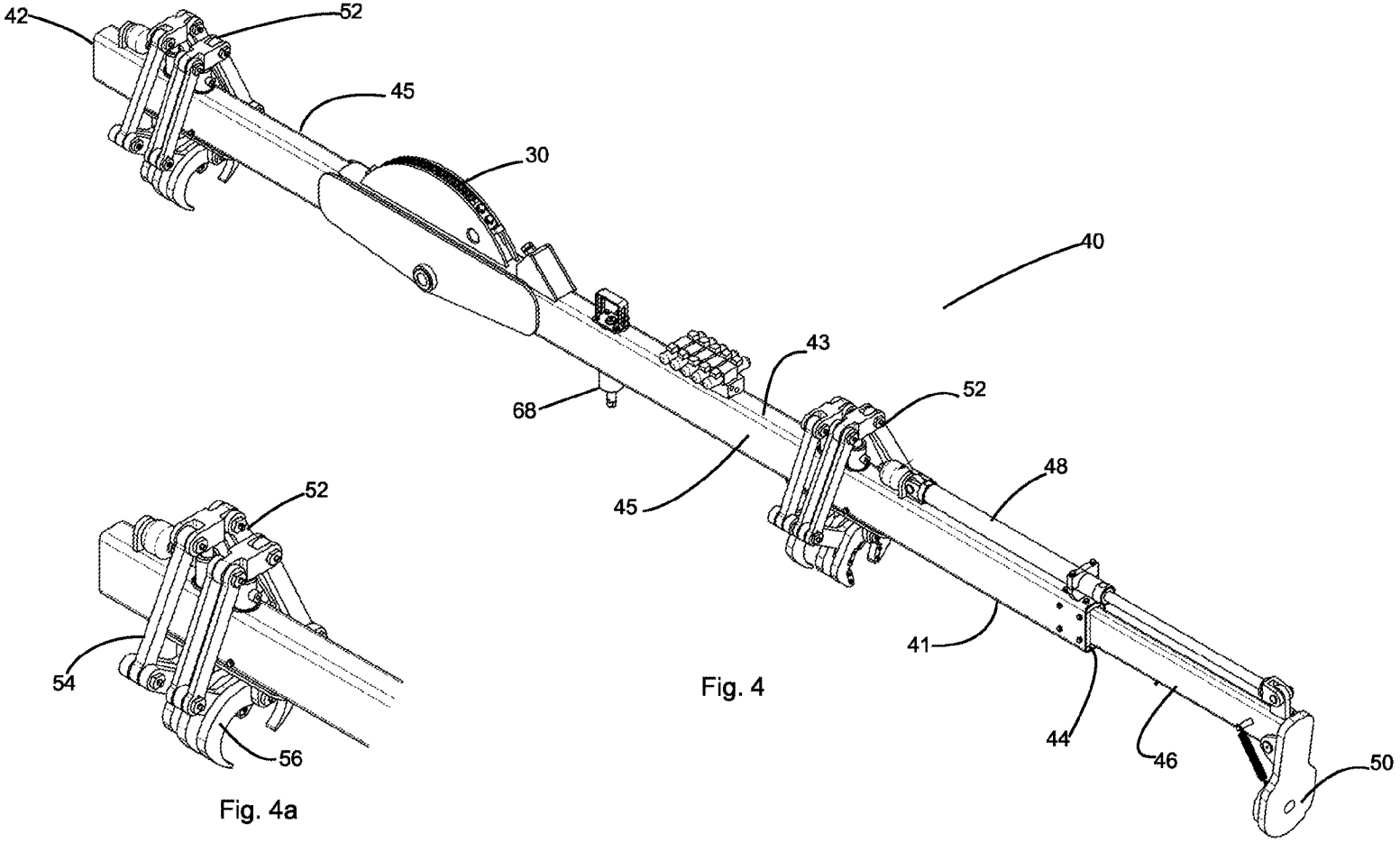
FIG. 4 is a perspective of a grabbing arm within the drill rod handler of FIG. 1.
FIG. 4*a* is an enlarged view of a portion of the grabbing arm of FIG. 4.
Figure 5:
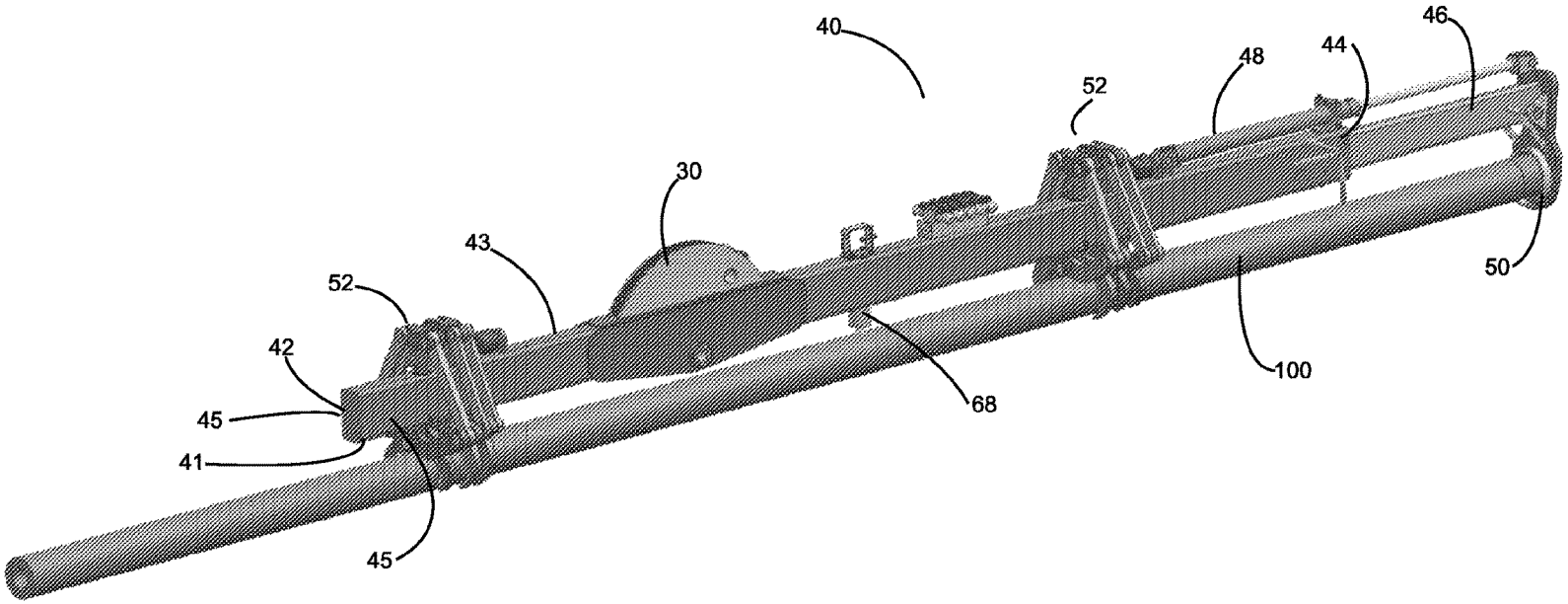
FIG. 5 is a schematic perspective of the grabbing arm of FIG. 4, shown during use.

The grabbing arm 40, as best seen in FIG. 4, is elongate, with a first end 42 and a second end 44. The grabbing arm 40 is generally rectangular prismatic in shape, with an inner face 41, an outer face 43 and two side faces 45 extending between the first end 42 and the second end 44. The rotational coupling 30 is mounted to the grabbing arm 40 on the outer face 43, about one third of the way from the first end 42 to the second end 44.

A hydraulically operated telescopic end portion 46 extends from the second end 44 in an elongate direction. The telescopic end portion 46 is controlled by a hydraulic ram 48. Operation of the hydraulic ram 48 acts to increase or decrease the effective length of the grabbing arm 40. The end portion 46 terminates in a foot 50 which extends inwardly; that is, extends generally perpendicular to the grabbing arm 40 on the inner face 41.

The grabbing portion includes two grasping means or grabbers 52, one located near the first end 42 and one located near the second end 44.

Figure 6:
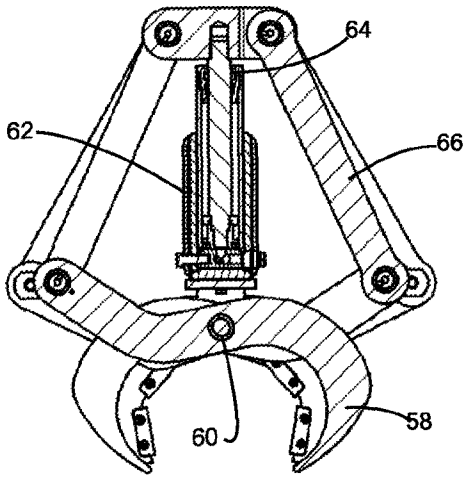
FIG. 6 is a cross section through a grasping means within the grabbing arm of FIG. 4.

Each grasping means 52 has a first grasping member 54 and a second grasping member 56. Operation of the first grasping member 54 will be described with reference to FIG. 6, with operation of the second grasping member 56 being substantially similar.

The first grasping member 54 has a set of grasping jaws 58 which are arranged to open and close by relative rotation of the jaws 58 about a pivot point 60. The pivot point 60 is fixed on the inner face 41 of the grabbing arm 40.

An operating hydraulic cylinder 62 is fixed on the outer face 43 of the grabbing arm 40, and has a ram 64 arranged to move in a direction perpendicular to the outer face 43. The ram 64 is fixed to a linking mechanism 66, which is in turn attached to the jaws 58.

The arrangement is such that movement of the ram 64 away from the outer face 43 causes the jaws 58 to close, forming a generally circular enclosure having a nominal circumference. Movement of the ram 64 towards the outer face 43 causes the jaws 58 to open. The plane of the generally circular enclosure is perpendicular to the elongate direction of the grabbing arm 40.

It will be appreciated that the direction of operation of the cylinder 62 is generally radial relative to the enclosure formed by the jaws 58.

The first grasping member 54 and the second grasping member 56 are located next to each other, with their respective jaws 58 being parallel. The nominal circumference of the jaws 58 of the first grasping member 54 is smaller than the nominal circumference of the jaws 58 of the second grasping member 56.

The grabbing arm 40 includes detection means to determine whether or not a rod 100 is in the correct position for grasping by the grasping means 52. The detection means may be an optical detector, such as a proximity sensor 68 located on the inner face 41 of the grabbing arm 40.

In use, the grabbing arm 40 is arranged such that the nominal circumference of the jaws 58 of the first grasping member 54 is similar to the circumference of the rod 100. When a rod 100 is in the appropriate position, and the grasping means 52 are activated, the first grasping members 54 will hold the rod 100 in position relative to the grabbing arm 40. The second grasping members 56 will extend around the rod 100 with a small clearance, and act to prevent detachment of the rod 100 from the grabbing arm 40 in the event of failure of a first grasping member 54.

The hydraulic ram 48 is actuated to bring the end portion 46 and the foot 50 into position near the end of the rod 100, in order to prevent loss of the rod 100 through slippage.

The bed 20 of the handler 10 includes three transversely extending raised supports 70 which support the rods 100 during transport. The raised supports 70 are arranged to telescope outwards from the side edges 16 to a distance even beyond that of the outriggers 18, such that during use rods 100 can be arrayed across the bed 20 not just from side edge 16 to side edge 16, but across the span of the supports 70.

The supports 70 each include a central portion 72 defined by two inclined surfaces which meet to form a concave V-shape. It will be appreciated that a rod 100 will readily come to rest across the base of this V-shape, in a stable position. This position can be considered a primed position.

Figure 3:
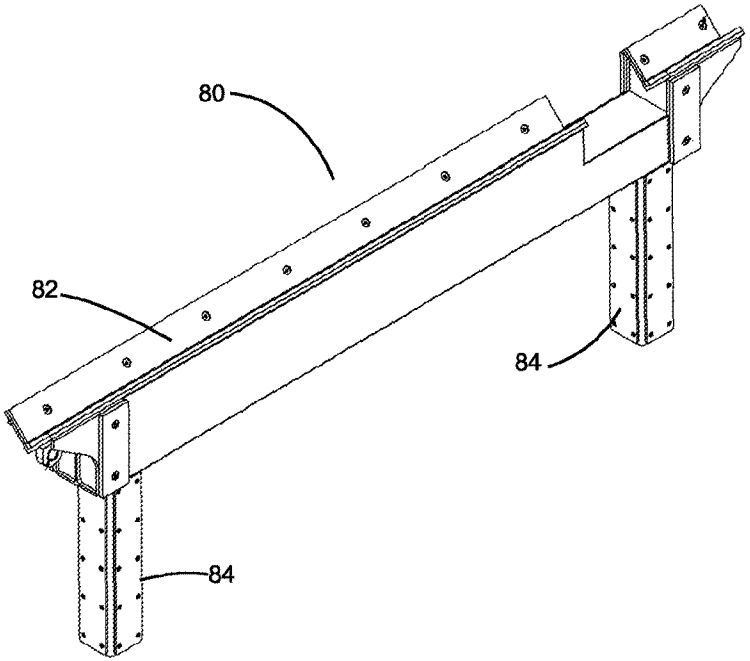
FIG. 3 is a perspective of a selector within the drill rod handler of FIG. 1.

The bed 20 includes an elongate selector 80 aligned with the central portion 72 of the supports. The selector 80, as shown in FIG. 3, includes an elongate cradle 82 arranged to support a rod 100, and two legs 84 which are associated with a hydraulic activation means within the bed 20 (not shown) to raise or lower the selector 80 relative to the bed 20.

The supports 70 include outer portions 74 hinged to the central portion 72. The arrangement is such that the outer portions 74, in conjunction with the outriggers 18, can be arranged to be generally horizontal; to be inclined away from the central portion 72; or to be inclined towards the central portion 72. In this way rods located on the outer portions 74 can be rolled towards or away from the central portion 72.

The bed 20 includes additional V-shaped members 76 aligned with the central portion 72. The additional V-shaped members 76 are each hinged at a side, and associated with a hydraulic activation means such that selected additional V-shaped members can be raised in order to provide impetus to a rod 100 to roll the rod 100 away from the central portion 72.

Use of the rod handler 10 will now be described with reference to FIGS. 7 to 15.

Figure 7:
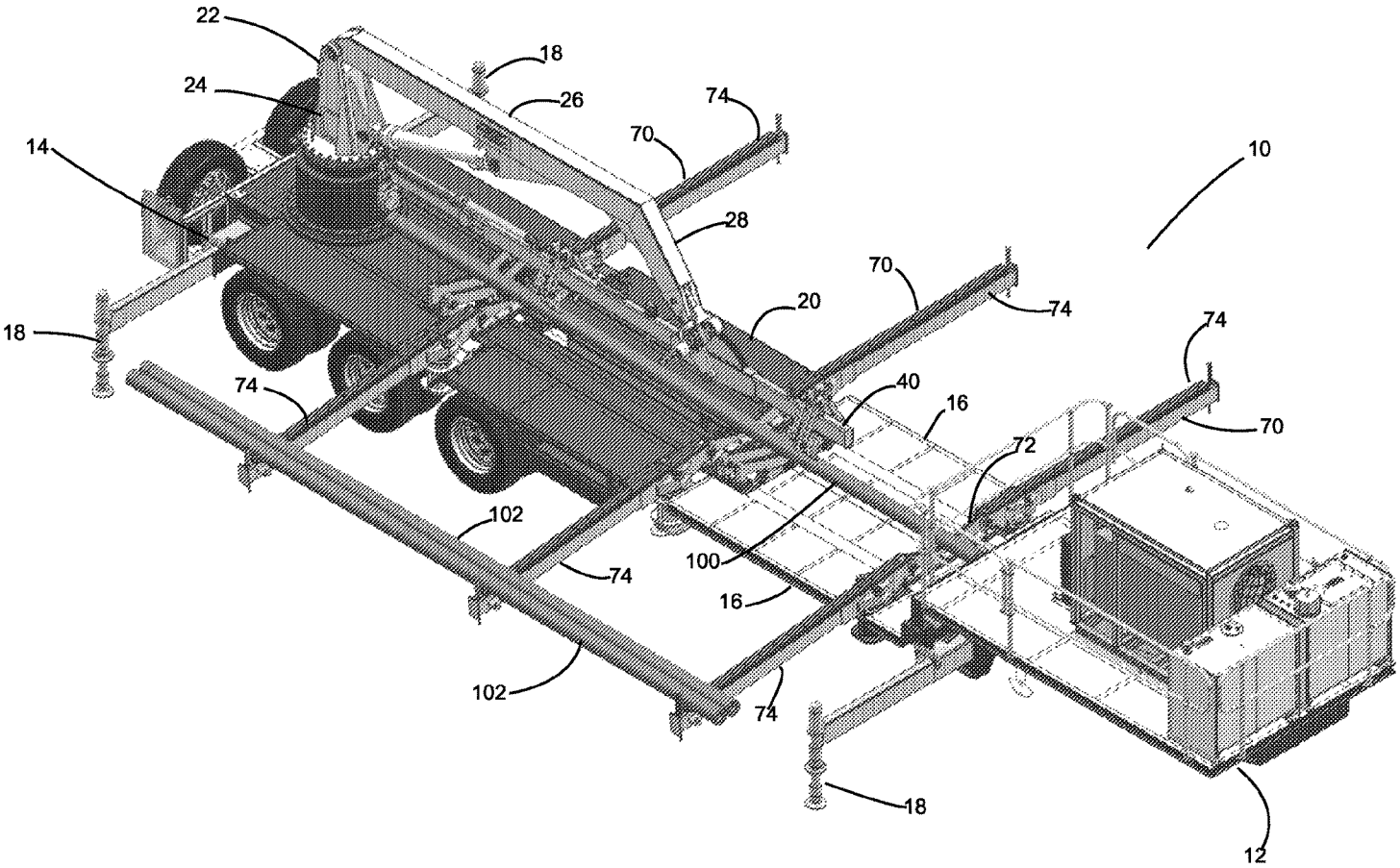
FIG. 7 is a perspective of the drill rod handler of FIG. 1 shown immediately prior to operation.
Figure 8:
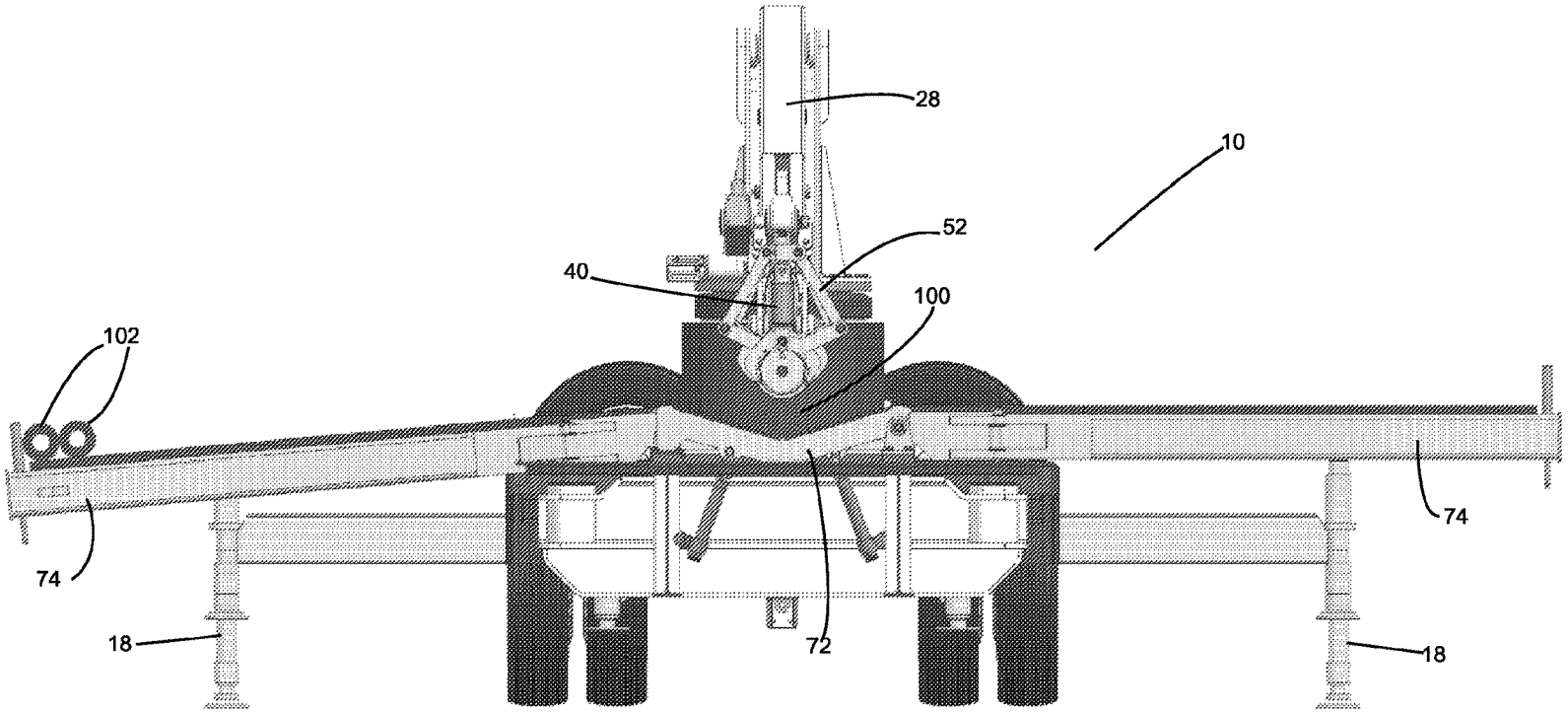
FIG. 8 is a cross section through the drill rod handler in the configuration of FIG. 7.

FIGS. 7 and 8 show the rod handler 10 in position ready for deployment of a rod 100. The rod 100 is located in the central portion 72 of the supports 70. One of the outer portions 74 is arranged in a holding position for further rods 102, being inclined away from the central portion 72. It will be observed that the outriggers 18 are deployed, and that the rods 100 extend from the base post 24 of the boom arm assembly 22 right to the forward end 12 of the bed 20. The working arm 26 and the grabbing arm 40 are both located directly above the rod 100.

As a safety precaution, the flow of hydraulic fluid to the boom arm assembly 22 and grabbing arm 40 is disabled unless all four outriggers 18 are properly deployed.

Figure 9:
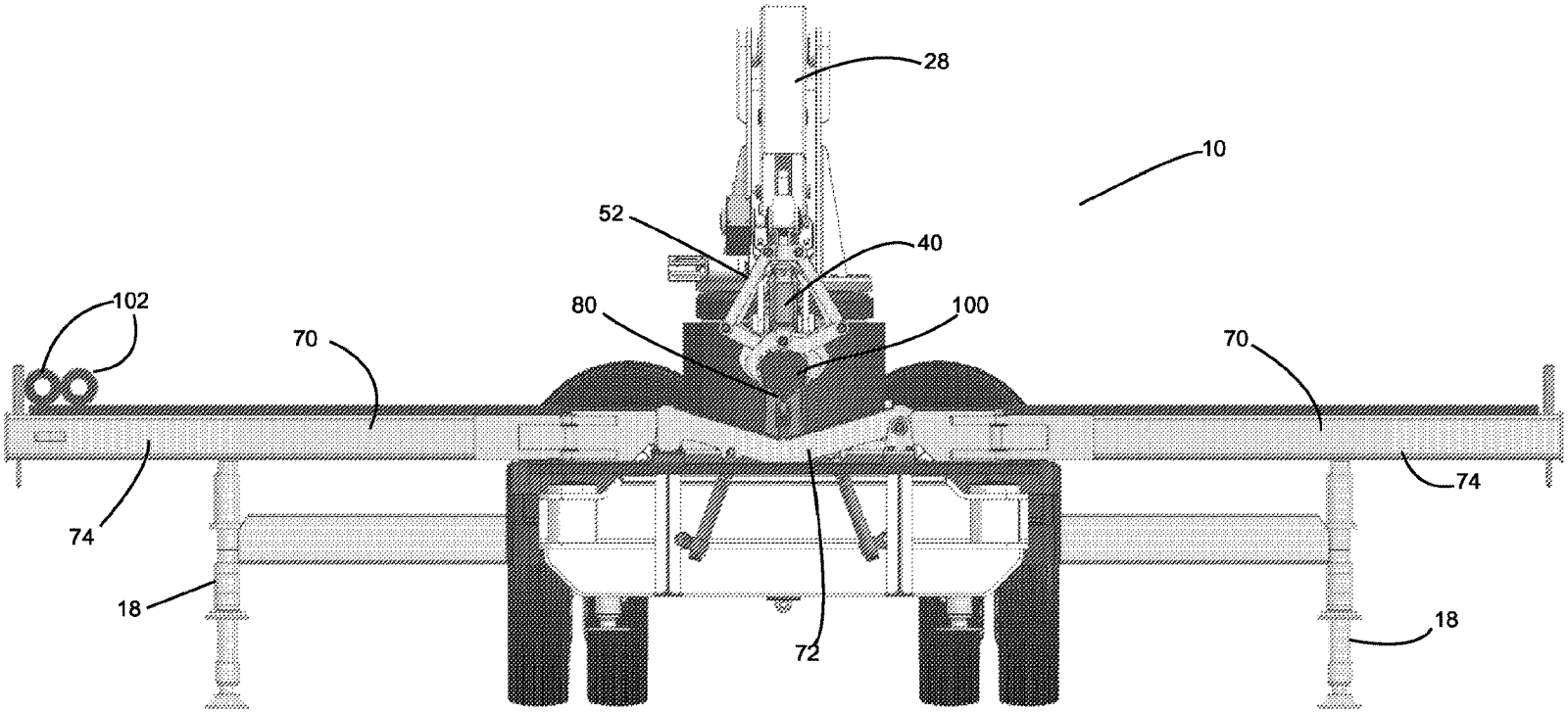
FIG. 9 is a cross section through the drill rod handler of FIG. 1, shown following raising of a selector.

The first action is the raising of the rod 100 using the selector 80. The rod 100 is held in the cradle 82, and as the legs 84 are lifted the rod 100 is moved into position within the grasping means 52. This is shown in FIG. 9. As a safety precaution, the selector 80 is disabled unless the grasping means 52 is open.

Figure 10:
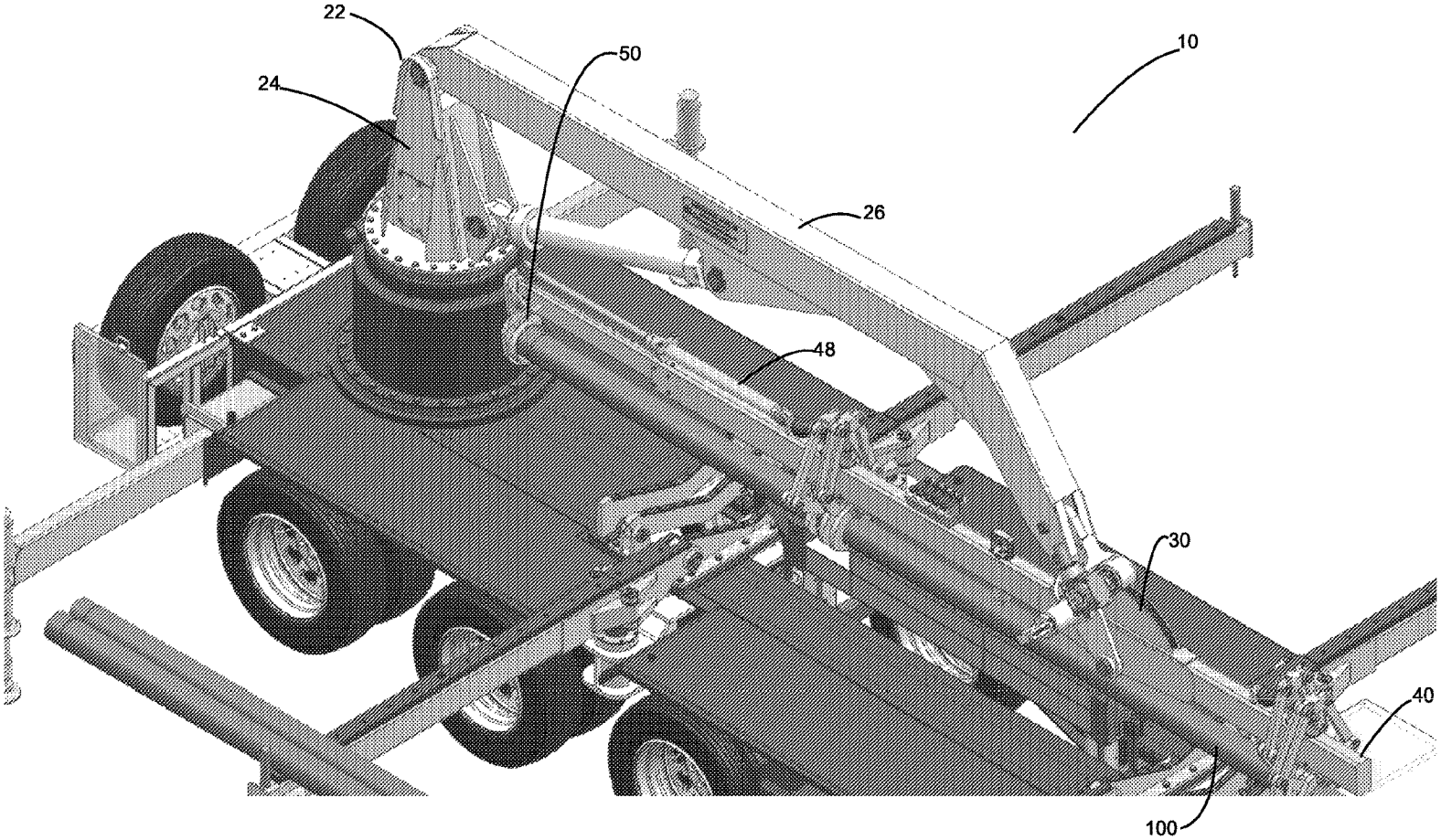
FIG. 10 is a perspective of a portion of the drill rod handler of FIG. 1, shown following grasping of a rod.
Figure 11:
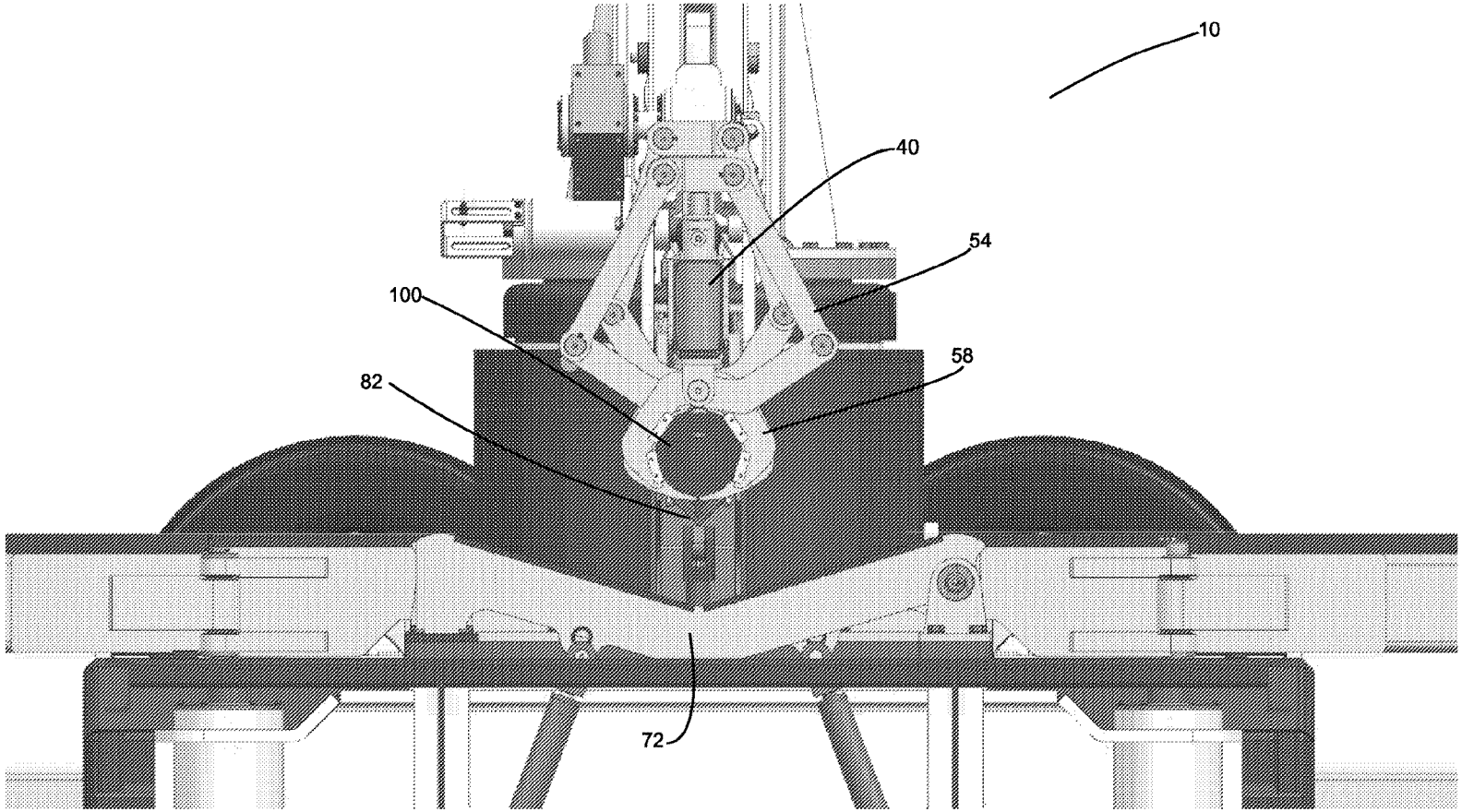
FIG. 11 is a cross section through the drill rod handler in the configuration of FIG. 10.

The grabbing arm 40 is then operated to grasp the rod 100. This includes the closing of the jaws 58, and the operation of the hydraulic ram 48 to bring the foot 50 against a base of the rod 100. This position is shown in FIGS. 10 and 11.

Figure 12:
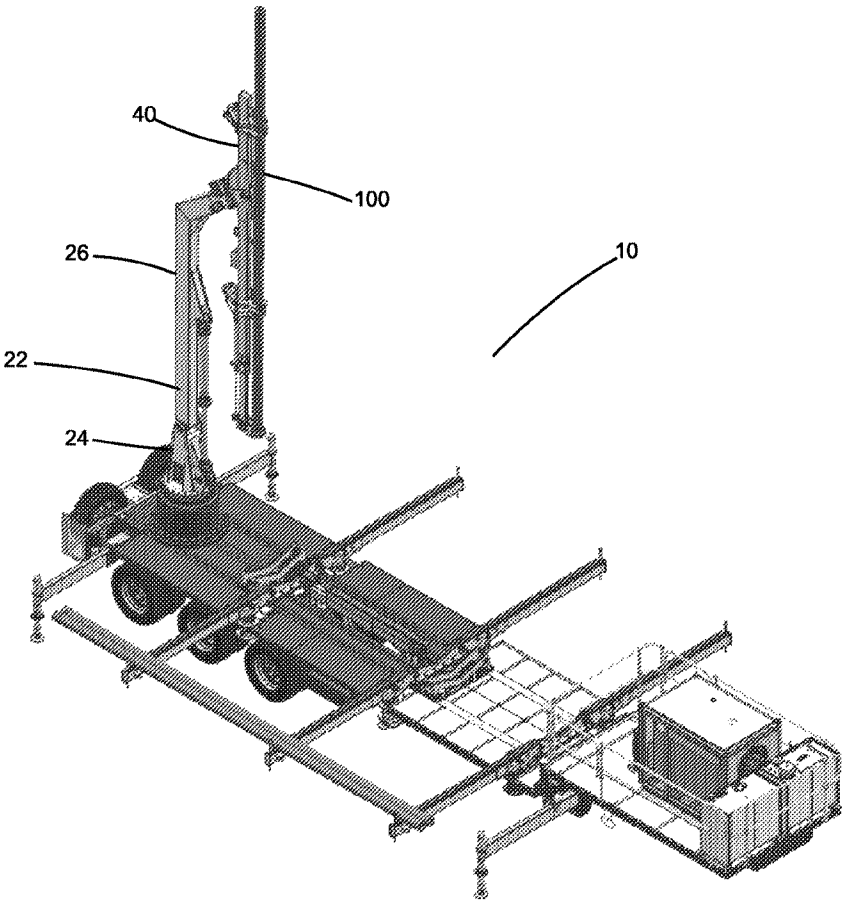
FIG. 12 is a perspective of the drill rod handler of FIG. 1, shown following raising of a rod.

Once the rod 100 has been grasped, it can be moved into position using the boom arm assembly 22. The first action is to raise the rod 100 to a vertical position, by rotating the working arm 26 by 90°. This is shown in FIG. 12. As a safety precaution, the working arm 26 cannot be operated unless the hydraulic pressure operating the grasping means 52 is above a predetermined limit (for instance, 2500 psi); the proximity sensor 68 shows the rod 100 to be securely in place; and the foot 50 is against the base of the rod 100.

Figure 13:
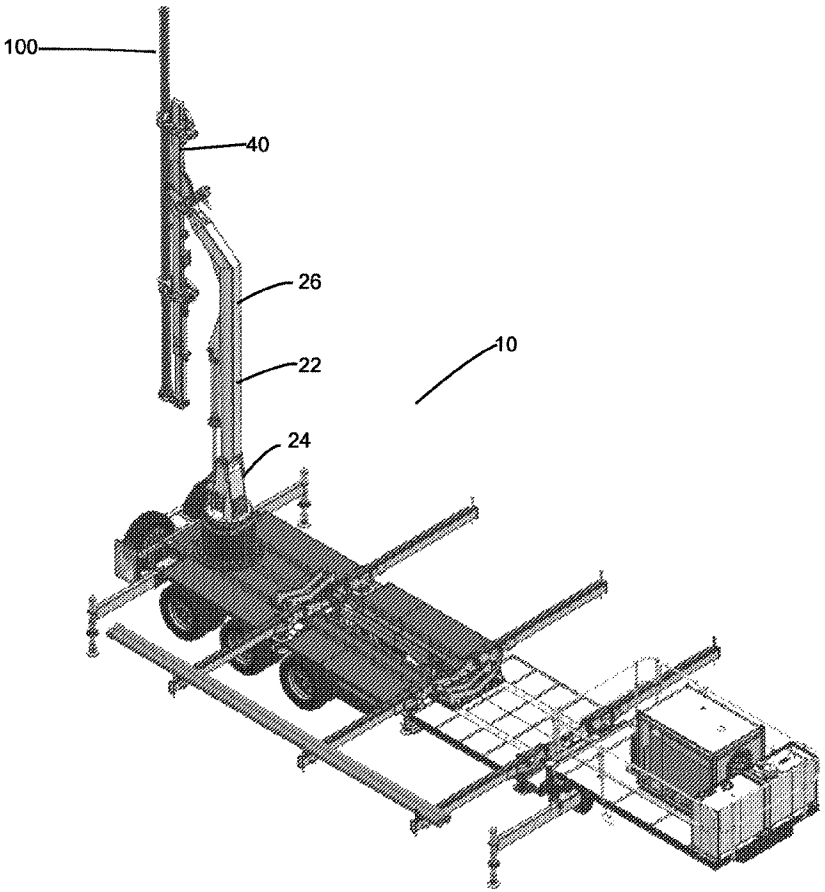
FIG. 13 is a perspective of the drill rod handler of FIG. 1, shown following slewing of a boom arm assembly.

The base post 24 can then be slewed 180°, placing the rod behind the rear end 14 of the handler 10. This is shown in FIG. 13. As a safety precaution, the base post 24 can only slew if the working arm 26 is in a vertical position.

Figure 14:
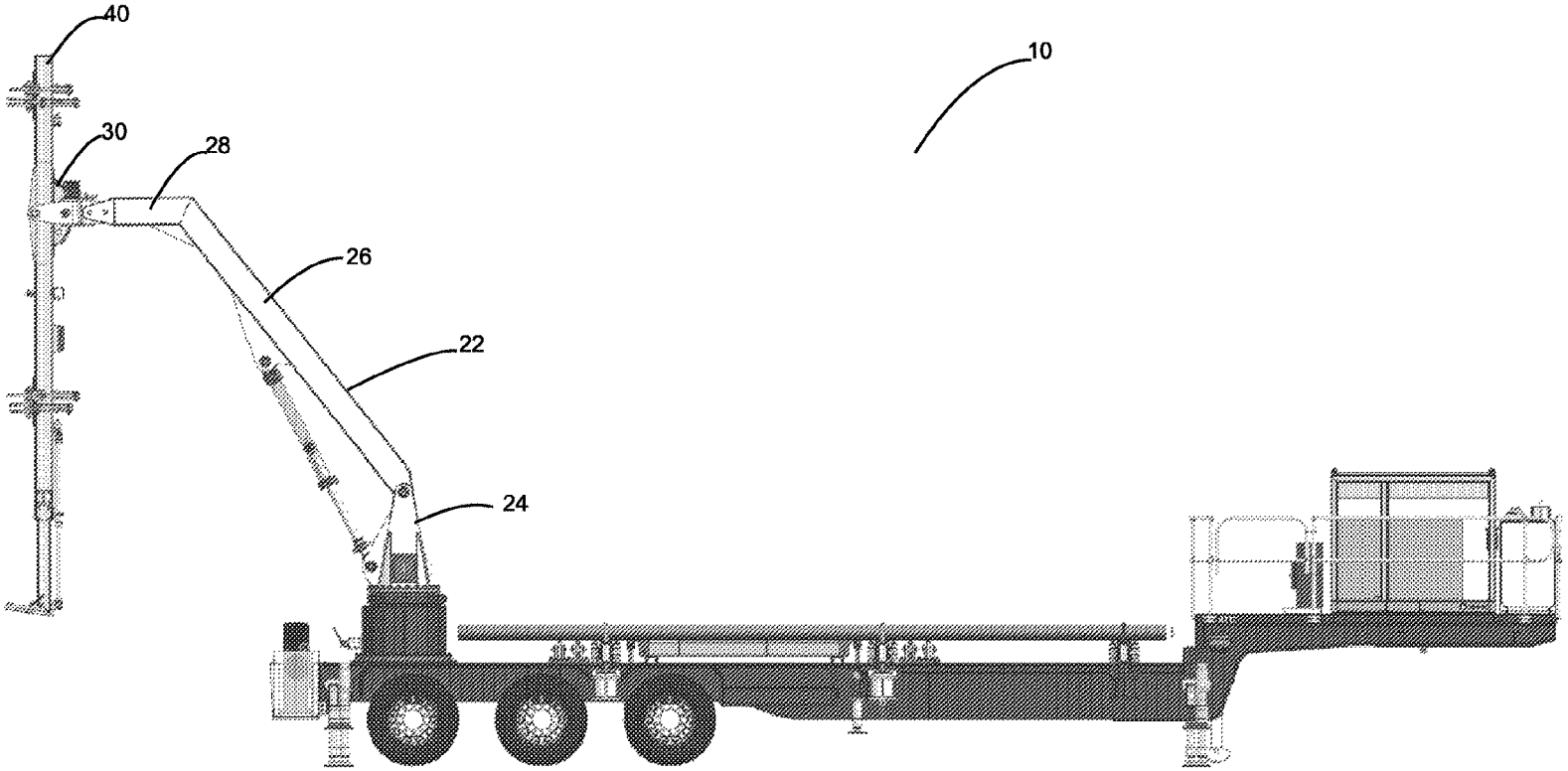
FIG. 14 is a side view of the drill rod handler of FIG. 1, shown as a rod is being lowered into position.

The rod 100 can then be lowered into position above the drill string (not shown), by rotating the working arm 26. In order to maintain the rod 100 in a vertical configuration, the rotational coupling 30 is also rotated by a corresponding angle. This is shown in FIG. 14.

Figure 15:
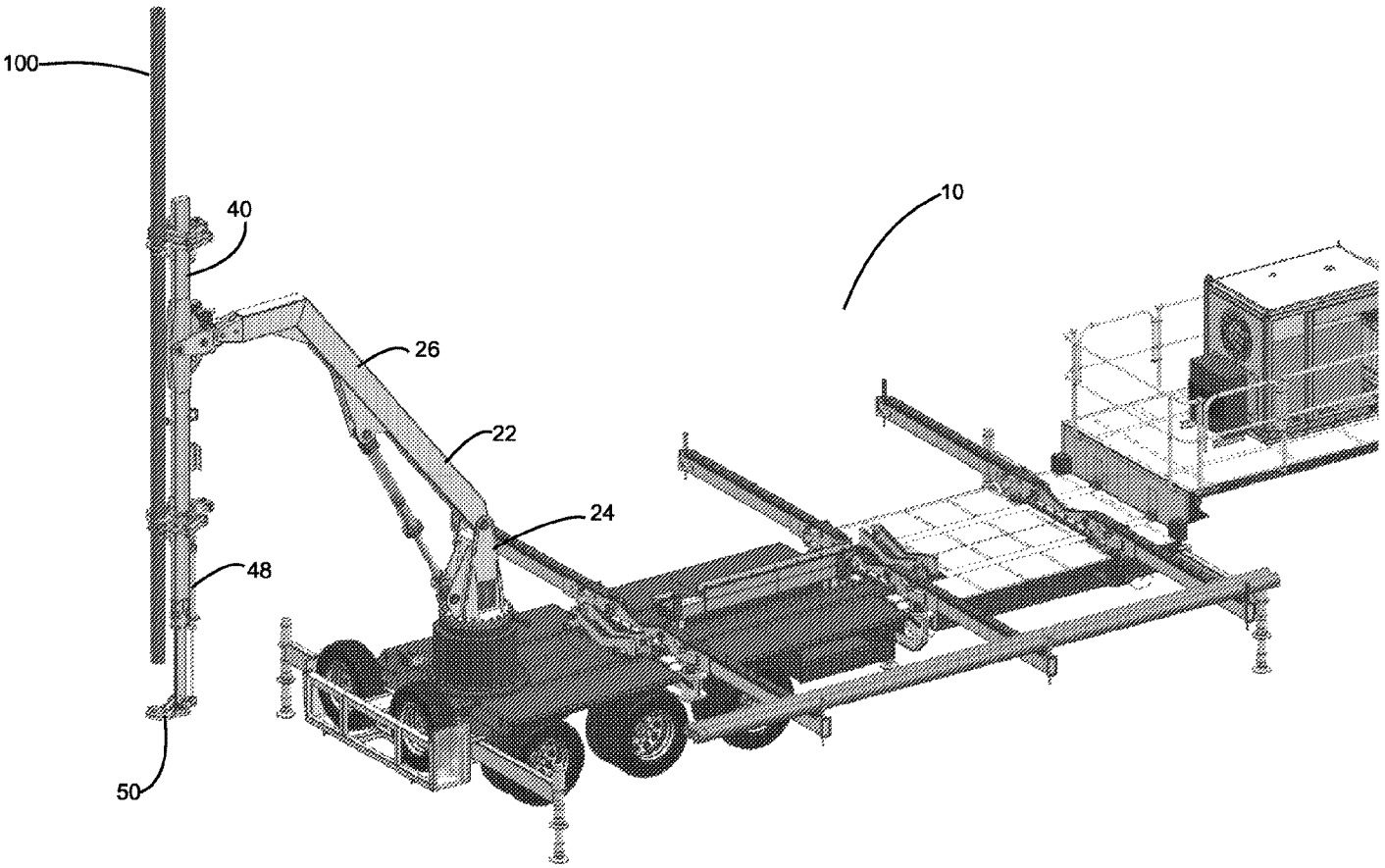
FIG. 15 is a perspective of the drill rod handler of FIG. 1, shown with a rod ready to be deployed.

FIG. 15 shows the final stage of deployment of the rod 100, where the hydraulic ram 48 is operated to displace the foot 50 from the rod 100, freeing the base of the rod 100 for connection to the drill string.

Figure 16:
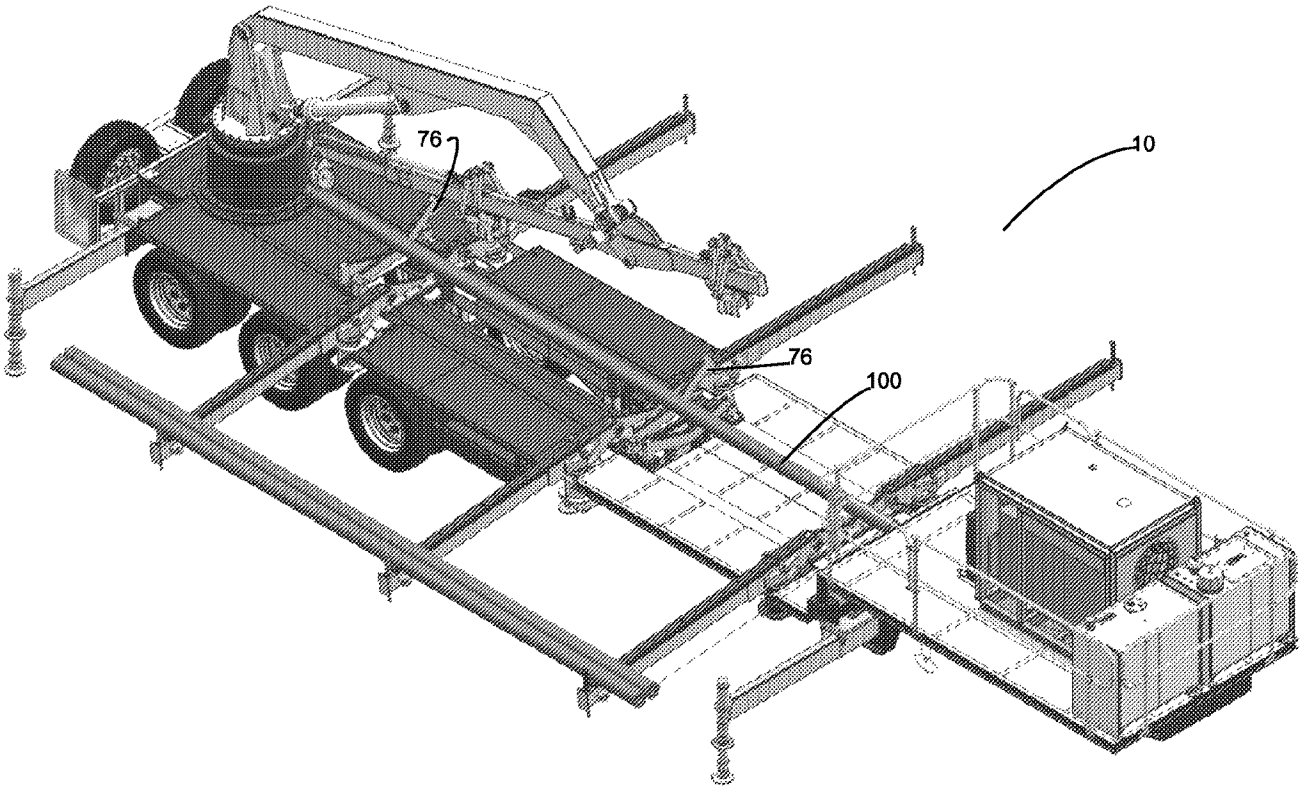
FIG. 16 is a perspective of the drill rod handler of FIG. 1, shown following return of a rod to the drill rod handler.

Rods 100 can be returned to the handler 10 using the reverse procedure. FIG. 16 shows a rod 100 which has just been returned to the handler 10. Additional V-shaped members 76 have been engaged in order to 'kick' the rod 100 away from the central portion 72 towards the outer portions 74.

Modifications and variations as would be apparent to a skilled addressee are deemed to be within the scope of the present invention.

Having described the invention, the following is claimed:

1. A grabbing arm for use in movement and manipulation of an elongate member, the grabbing arm being generally elongate, wherein said grabbing arm comprises:

a first grabber and a second grabber, each of said first and second grabbers spaced apart from each other in an elongate direction and configured to engage with said elongate member for movement and manipulation of said elongate member, wherein each of said first and second grabbers include:

a primary grasper and a secondary grasper that are each independently moveable between an open configuration and a closed configuration, said primary grasper having a first effective circumference in the closed configuration, and said secondary grasper having a second effective circumference in the closed configuration, wherein each of the primary and secondary graspers includes a set of jaws operated by a linking structure, wherein the first effective circumference of the primary grasper is substantially the same as the circumference of said elongate member, and the second effective circumference of the second grasper is larger than the first effective circumference, and wherein the primary grasper of the first grabber is spaced apart in the elongate direction from the primary grasper of the second grabber, and the secondary grasper of the first grabber is spaced apart in the elongate direction from the secondary grasper of the second grabber, wherein each first and second grabber is moveable between (i) an open position in which both respective primary and secondary graspers are in their open configuration and (ii) a closed position in which both respective primary and secondary graspers are in their closed configuration, said primary grasper of each of the first and second grabbers being sized to grasp and hold the elongate member in the closed configuration and the secondary grasper of each of the first and second grabbers being sized to be at least partially spaced from the elongate member in the closed configuration.

2. A grabbing arm as claimed in claim 1, wherein the linking structure is arranged such that the operation of an operating cylinder causes opening and closing of the jaws.

3. A grabbing arm as claimed in claim 2, wherein the operating cylinder is arranged to operate radially relative to the area bounded by the jaws.

4. A grabbing arm as claimed in claim 1, wherein the grabbing arm has a moveable foot.

5. A grabbing arm as claimed in claim 4, wherein the moveable foot is arranged to move in an elongate direction.

6. A grabbing arm as claimed in claim 1, wherein the grabbing arm includes a detection means to indicate whether the elongate member is in a position to be grasped by the first and second grabbers.

* * * * *